US006136911A

United States Patent [19]

Shin et al.

[11] Patent Number: 6,136,911

[45] Date of Patent: Oct. 24, 2000

[54] FIBERS FLASH-SPUN FROM PARTIALLY FLUORINATED POLYMERS

[75] Inventors: Hyunkook Shin, Wilmington, Del.; James Ross Waggoner, Midlothian, Va.; John Edward Armstrong, Newark, Del.

[73] Assignee: E.I. du Pont de Nemours and Company, Wilmington, Del.

[21] Appl. No.: 09/101,118

[22] PCT Filed: Jan. 9, 1997

[86] PCT No.: PCT/US97/00160

§ 371 Date: Jun. 30, 1998

§ 102(e) Date: Jun. 30, 1998

[87] PCT Pub. No.: WO97/25460

PCT Pub. Date: Jul. 17, 1997

Related U.S. Application Data

[60] Provisional application No. 60/009,739, Jan. 11, 1996.

[51] Int. Cl.[7] ..... D01D 5/11; D01F 6/32; C08J 3/09; C08L 27/12

[52] U.S. Cl. ..... 524/463; 264/13; 264/205; 264/211.14; 524/466; 524/473

[58] Field of Search ..... 442/59, 327; 524/463, 524/466, 473; 264/13, 205, 211.4

[56] References Cited

U.S. PATENT DOCUMENTS

| | | | |
|---|---|---|---|
| 3,081,519 | 3/1963 | Blades et al. . | |
| 3,227,664 | 1/1966 | Blades et al. | 260/2.5 |
| 3,227,784 | 1/1966 | Blades et al. | 264/53 |
| 3,484,899 | 12/1969 | Smith | 18/8 |
| 3,584,090 | 6/1971 | Parrish | 264/45 |
| 3,624,250 | 11/1971 | Carlson | 260/80.75 |
| 3,851,023 | 11/1974 | Brethauer et al. | 264/24 |
| 3,870,689 | 3/1975 | Modena et al. | 260/87.5 B |
| 4,054,625 | 10/1977 | Kozlowski et al. | 264/13 |
| 4,608,089 | 8/1986 | Gale et al. | 106/90 |
| 4,642,262 | 2/1987 | Piotrowski et al. | 428/296 |
| 4,677,175 | 6/1987 | Ihara et al. | 526/254 |
| 5,147,586 | 9/1992 | Shin et al. | 264/13 |
| 5,192,468 | 3/1993 | Coates et al. | 264/13 |
| 5,279,776 | 1/1994 | Shah | 264/12 |
| 5,290,846 | 3/1994 | Tuminello | 524/463 |
| 5,328,946 | 7/1994 | Tuminello et al. | 524/462 |
| 5,364,929 | 11/1994 | Dee et al. | 528/491 |
| 5,371,810 | 12/1994 | Vaidyanathan | 382/48 |
| 5,816,700 | 10/1998 | Starke, Sr. et al. | 366/147 |

FOREIGN PATENT DOCUMENTS

| | | |
|---|---|---|
| 1106307 | 12/1955 | France . |

*Primary Examiner*—Blaine Copenheaver
*Assistant Examiner*—Ula C. Ruddock

[57] ABSTRACT

A flash-spun material comprised of at least 20% partially fluorinated hydrocarbon polymers in which between 10% and 70% of the total number of hydrogen atoms in each hydrocarbon polymer are replaced by fluorine atoms. The partially fluorinated hydrocarbon polymers is preferably comprised of at least 80% by weight of polymerized monomer units selected from ethylene, tetrafluoroethylene, chlorotrifluoroethylene, vinylidene fluoride and vinyl fluoride. The flash-spun material may be a plexifilamentary strand or a microcellular foam. Also provided is a process for producing flash-spun material from partially fluorinated hydrocarbon polymers in a solvent and a solution from which such polymers may be flash-spun.

10 Claims, 6 Drawing Sheets

FIBERS FLASH-SPUN FROM PARTIALLY FLUORINATED POLYMERS

This application claims benefit of Provisional Application Ser. No. 60/009,739 filed Jan. 11, 1996.

BACKGROUND OF THE INVENTION

This invention relates to fibers that are flash-spun from partially fluorinated hydrocarbon polymers and a solvent.

The art of flash-spinning strands of plexifilamentary film-fibrils from polymer in a solution or a dispersion is known in the art. The term "plexifilamentary" means a three-dimensional integral network of a multitude of thin, ribbon-like, film-fibril elements of random length and with a mean film thickness of less than about 4 microns and with a median fibril width of less than about 25 microns. In plexifilamentary structures, the film-fibril elements are generally coextensively aligned with the longitudinal axis of the structure and they intermittently unite and separate at irregular intervals in various places throughout the length, width and thickness of the structure to form a continuous three-dimensional network.

U.S. Pat. No. 3,227,784 to Blades et al. (assigned to E.I. du Pont de Nemours & Company ("DuPont")) describes a process wherein a polymer in solution is forwarded continuously to a spin orifice at a temperature above the boiling point of the solvent, and at autogenous pressure or greater, and is flash-spun into a zone of lower temperature and substantially lower pressure to generate a strand of plexifilamentary material. U.S. Pat. No. 5,192,468 to Coates et al. (assigned to DuPont) discloses another process for flash-spinning a plexifilamentary strand according to which a mechanically generated dispersion of melt-spinnable polymer, carbon dioxide and water under high pressure is flashed through a spin orifice into a zone of substantially lower temperature and pressure to form a plexifilamentary strand.

U.S. Pat. No. 3,227,794 to Anderson et al. (assigned to DuPont) teaches that plexifilamentary film-fibrils are best obtained from solution when fiber-forming polymer is dissolved in a solvent at a temperature and at a pressure above which two liquid phases form, which pressure is generally known as the cloud point pressure at the given temperature. This solution is passed to a pressure let-down chamber, where the pressure decreases below the cloud point pressure for the solution thereby causing phase separation. The resulting two phase dispersion of a solvent-rich phase in a polymer-rich phase is discharged through a spinneret orifice to form the plexifilamentary strand.

U.S. Pat. No. 3,484,899 to Smith (assigned to DuPont) discloses an apparatus with a horizontally oriented spin orifice through which a plexifilamentary strand can be flash-spun. The polymer strand is conventionally directed against a rotating lobed deflector baffle to spread the strand into a more planar web structure that the baffle alternately directs to the left and right as the web descends to a moving collection belt. The fibrous sheet formed on the belt has plexifilamentary film-fibril networks oriented in an overlapping multi-directional configuration.

Many improvements to the basic flash-spinning process have been reported or patented over the years. Flash-spinning of olefin polymers to produce non-woven sheets is practiced commercially and is the subject of numerous patents including U.S. Pat. No. 3,851,023 to Brethauer et al (assigned to DuPont). Flash-spinning of olefin polymers to produce pulp-like products from polymer solutions is disclosed in U.S. Pat. No. 5,279,776 to Shah (assigned to DuPont). Flash-spinning of olefin polymers to produce microcellular and ultra-microcellular foam products from polymer solutions is disclosed in U.S. Pat. Nos. 3,227,664 to Blades et al. and 3,584,090 to Parrish (assigned to DuPont).

The commercial application for flash-spinning has been primarily directed to the manufacture of polyolefin plexifilaments, especially of polyethylene and polypropylene. However, experimental work directed to the flash-spinning of other polymers, has been reported. For example, U.S. Pat. No. 3,227,784 to Blades et al. describes the flash-spinning of a solution of a perfluoroethylene/perfluoropropylene (90:10) copolymer from a solution in p-bis(trifluoromethyl)benzene (Example 30). Applicants are not aware of commercial flash-spinning of such fluoropolymers. U.S. Pat. Nos. 5,328,946 and 5,364,929 disclose solutions of tetrafluoroethylene polymers at superautogenous pressure in perfluorinated cycloalkane solvents.

As used herein, "partially fluorinated hydrocarbon" refers to an organic compound that would be a hydrocarbon except that one or more of the compound's hydrogen atoms have been replaced by fluorine atoms.

Partially fluorinated hydrocarbon polymer and copolymer films exhibit a variety of outstanding characteristics such as excellent resistance to acids, bases, and most organic liquids under normal temperature and pressure conditions; excellent dielectric properties; good tensile properties; good resistance to heat and weather; a relatively high melting point; and good fire retardance. Partially fluorinated hydrocarbon polymers and copolymer films are extensively used in high value applications such as insulation for high speed electrical transmission cables. Flash-spun plexifilaments of such polymers and copolymers should find wide use in other high value applications such as, for example, hot gas filtration media, pump packings, gaskets, and protective apparel. However, because of their relatively high melting points and outstanding chemical inertness, partially fluorinated hydrocarbon polymers are very difficult to dissolve, and therefore it had not been possible to flash-spin such polymers. Commercially available spunbonded fabrics are all made from polyethylene, polypropylene, nylon, and polyester, which are highly combustible. Accordingly, there is a need for nonflammable spunbonded fabric for protective garments and other critical end uses. In addition, there is a need for partially fluorinated hydrocarbon polymer and copolymer plexifilaments that exhibit excellent heat and chemical resistance, good dielectric properties, and good non-stick characteristics. There also is a need for a process suitable for use in commercial flash-spinning of partially fluorinated hydrocarbon polymers using conventional spinning equipment under conventional commercial temperature and pressure conditions.

SUMMARY OF THE INVENTION

According to the present invention, there is provided a flash-spun material comprised of at least 20% partially fluorinated hydrocarbon polymers in which between 10% and 70% of the total number of hydrogen atoms in each hydrocarbon polymer are replaced by fluorine atoms. Preferably, the partially fluorinated hydrocarbon polymers are comprised of at least 80% by weight of polymerized monomer units selected from ethylene, tetrafluoroethylene, chlorotrifluoroethylene, vinylidene fluoride and vinyl fluoride. According to one preferred embodiment of the invention, 40% to 70% by weight of the hydrocarbon polymers are comprised of polymerized monomer units of tetrafluoroethylene and 10% to 60% of said hydrocarbon polymers are comprised of polymerized monomer units of ethylene. According to another preferred embodiment of the invention, 40% to 70% by weight of the hydrocarbon polymers are be comprised of polymerized monomer units of chlorotrifluoroethylene and 10% to 60% by weight of the hydrocarbon polymers comprised of polymerized monomer units of ethylene. According to other preferred embodiments of the invention, at least 80% by weight of the hydrocarbon polymers are comprised of a homopolymer of either difluoroethylene or fluoroethylene.

The flash-spun material may be a plexifilamentary strand having a surface area, measured by the BET nitrogen adsorption method, greater than 2 $m^2/g$. The plexifilamentary strand comprises a three dimensional integral plexus of semicrystalline, polymeric, fibrous elements that are co-extensively aligned with the axis of the plexifilament and have the structural configuration of oriented film-fibrils. The film-fibrils have a mean film thickness of less than about 4 microns and median fibril width of less than about 25 microns. Alternatively, the flash-spun material may be a microcellular foam. The invention is also directed to a process for producing flash-spun material from partially fluorinated hydrocarbon polymers in a solvent and a solution from which such polymers may be flash-spun.

BRIEF DESCRIPTION OF THE DRAWINGS

The accompanying drawings, which are incorporated in and constitute a part of this specification, illustrate the presently preferred embodiments of the invention and, together with the description, serve to explain the principles of the invention.

DETAILED DESCRIPTION

Figure 1:
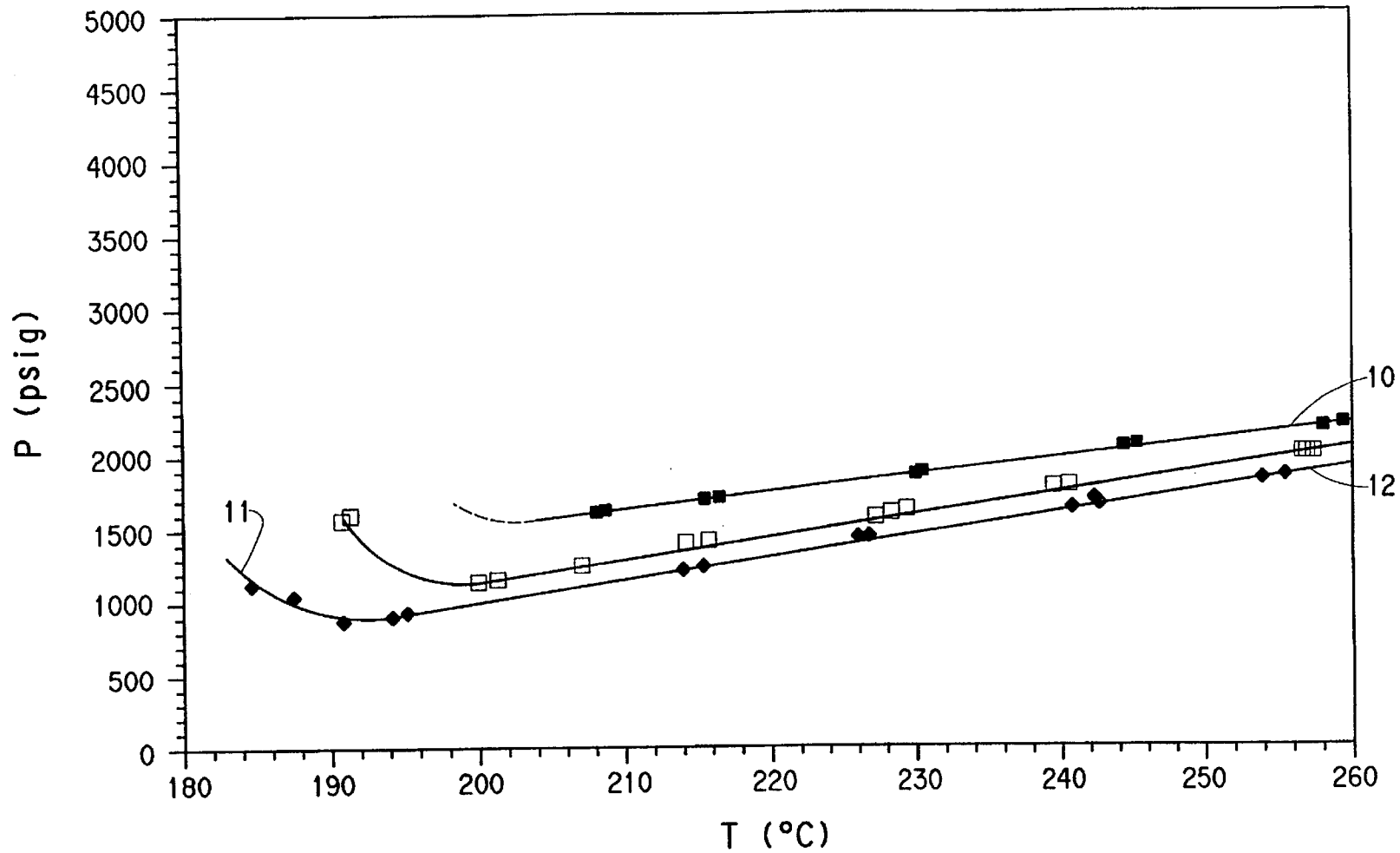
FIG. 1 is a plot of the cloud point data for a solution comprised of 25% of an ethylene/tetrafluoroethylene copolymer in a solvent comprised of pentane and acetone at a number of different solvent ratios.

Reference will now be made in detail to the presently preferred embodiments of the invention, examples of which are illustrated below.

The flash-spun partially fluorinated plexifilaments of the invention can be spun using the apparatus and flash-spinning process disclosed and fully described in U.S. Pat. No. 5,147,586 to Shin et al. It is anticipated that in commercial applications, partially fluorinated plexifilamentary sheets could be produced using the apparatus disclosed in U.S. Pat. No. 3,851,023 to Brethauer et al.

The process for flash-spinning plexifilaments from a partially fluorinated hydrocarbon polymer and a solvent operates under conditions of elevated temperature and pressure. The polymeric starting material is normally not soluble in the selected solvent under normal temperature and pressure conditions but forms a solution at certain elevated temperatures and pressures. We have now found that partially fluorinated hydrocarbon polymers become soluble in certain types of solvents if high enough temperatures and pressures are applied. Surprisingly, partially fluorinated hydrocarbon polymers become soluble in certain polar solvents such as alcohols and ketones, and in certain types of chlorinated solvents and hydrofluorocarbons (HFC's) at high temperatures and pressures. The HFC's are newly developed solvents which have become available recently as a replacement for ozone depleting fully halogenated chlorofluorocarbons (CFC's).

As long as the pressure is maintained above the cloud point pressure, the partially fluorinated hydrocarbon polymer remains in solution. In the flash-spinning process, pressure is decreased below the cloud point, just before the solution is passed through a spinneret. When the solution pressure is lowered below the cloud point pressure, the solution phase separates into a polymer-rich phase and a solvent-rich phase. Upon passing through the spinneret at very high speed into a zone of substantially lower pressure, the solvent flashes off quickly and the polymer material present in the polymer-rich phase freezes in an elongated plexifilamentary form.

The morphology of fiber strands obtained by solution flash-spinning of partially fluorinated hydrocarbon polymer is greatly influenced by the type of solvent in which the polymer is dissolved, the concentration of the polymer in the spin solution, and the spin conditions. To obtain plexifilaments, polymer concentration is kept relatively low (e.g., less than about 35 weight percent), while spin temperatures and pressures are generally kept high enough to provide rapid flashing of the solvent. Microcellular foam fibers, on the other hand, are usually prepared at relatively high polymer concentrations and at lower spin temperatures and pressures.

Well fibrillated plexifilaments are usually obtained when the spin temperature used is between the critical temperature of the spin liquid and 40° C. below the critical temperature, and when the spin pressure is slightly below the cloud point pressure. When the spin pressure is much greater than the cloud point pressure of the spin mixture, coarse plexifilamentary "yarn-like" strands are usually obtained. As the spin pressure is gradually decreased, the average distance between the tie points of the fibrils of the strands generally becomes shorter while the fibrils become progressively finer. When the spin pressure approaches the cloud point pressure of the spin mixture, very fine fibrils are normally obtained, and the distance between the tie points becomes very short. As the spin pressure is further reduced to below the cloud point pressure, the distance between the tie points becomes longer. Well fibrillated plexifilaments, which are most suitable for sheet formation, are usually obtained when spin pressures slightly below the cloud point pressure are used. The use of pressures which are too much lower than the cloud point pressure of the spin mixture generally leads to a relatively coarse fiber structure. In some cases, well fibrillated plexifilaments can be obtained even at spin pressures slightly higher than the cloud point pressure of the spin mixture.

For flash-spinning of microcellular foam fibers, relatively strong solvents are used to obtain relatively low cloud point pressures that are above the cloud point pressure. Microcellular foams are usually prepared at relatively high polymer concentrations in the spinning solution and at relatively low spinning temperatures and pressures that are above the cloud point pressure. Microcellular foam fibers may be obtained rather than plexifilaments, even at spinning pressures slightly below the cloud point pressure of the solution. Nucleating agents, such as fused silica and kaolin, may be added to the spin mix to facilitate solvent flashing and to obtain uniform small size cells. Microcellular foams can be obtained in a collapsed form or in a fully or partially inflated form. For many polymer/solvent systems, microcellular foams tend to collapse after exiting the spinning orifice as the solvent vapor condenses inside the cells and/or diffuses out of the cells. To obtain low density inflated foams, inflating agents are usually added to the spin liquid. Inflating agents to be used should have a permeability coefficient for diffusion through the cell walls that is less than that of air so that the agent can stay inside the cells for a long period of time while allowing air to diffuse into the cells to keep the cells inflated. Osmotic pressure will cause air to diffuse into the cells. Suitable inflating agents that can be used include low boiling temperature partially halogenated hydrocarbons and halocarbons such as hydrochlorofluorocarbons, hydrofluorocarbons, chlorofluorocarbons, and perfluorocarbons; inert gases such as carbon dioxide and nitrogen; low boiling temperature hydrocarbon solvents such as butane and isopentane; and other low boiling temperature organic solvents and gases. The atmospheric boiling points will be around room temperature or lower.

Microcellular foam fibers are normally spun from a round cross section spin orifice. However, an annular die similar to the ones used for blown films can be used to make microcellular foam sheets. Fully inflated foams, as-spun fibers or as-extruded foam sheets can be post-inflated by immersing them in a solvent containing dissolved inflatants. Inflatants will diffuse into the cells due to the plasticizing action of the solvent. Once dried, the inflatants will stay inside the cells and air will diffuse into the cells due to osmotic pressure to keep the microcellular foams inflated. Microcellular foams have densities between 0.005 and 0.50 g/cc. Their cells are generally of a polyhedral shape and their average cell size is less than about 300 microns, and is preferably less than about 150 microns. Their cell walls are typically less than about 3 microns thick, and they are typically less than about 2 microns in thickness.

Plexifilamentary pulps of partially fluorinated hydrocarbon polymers can be produced by disc refining flash-spun plexifilaments as disclosed in U.S. Pat. No. 4,608,089 to Gale et al. (assigned to DuPont). Alternatively, such pulps can be prepared directly from polymer solutions by flash-spinning using a device similar to the one disclosed in U.S. Pat. No. 5,279,776. These pulps are plexifilamentary in nature and they can have a three dimensional network structure. However, the pulp fibers are relatively short in length and they have small dimensions in the transverse direction. The average fiber length is less than about 200 microns, and is preferably less than 50 microns. The pulp fibers have a relatively high surface area of greater than 2 $m^2/g$.

Polymers that may be flash-spun to produce the partially fluorinated hydrocarbon polymer plexifilaments of the invention are hydrocarbon polymers in which between 10% and 70% of the total number of hydrogen atoms in the hydrocarbon polymer are replaced by fluorine atoms. Preferably, the partially fluorinated hydrocarbon polymers are comprised of at least 80% by weight of polymerized monomer units selected from ethylene, tetrafluoroethylene, chlorotrifluoroethylene, vinylidene fluoride and vinyl fluoride. A particularly preferred partially fluorinated hydrocarbon polymer is comprised of 40% to 70% by weight of polymerized monomer units of tetrafluoroethylene and 10% to 60% by weight of polymerized monomer units of ethylene, such as a copolymer comprised of substantially alternating units of ethylene and tetrafluoroethylene with the chemical structure —$(CH_2CH_2)$—$(CF_2CF_2)$—. Such ethylene/tetrafluoroethylene copolymers are disclosed, for example, in U.S. Pat. Nos. 3,624,250 to Carlson (assigned to DuPont), 3,870,689 to Modena et al., and 4,677,175 to Ihara et al. Ethylene/tetrafluoroethylene copolymer resin is commercially available from DuPont under the tradename TEFZEL®, which is a registered trademark of DuPont. TEFZEL® fluoropolymer resins have a melting points between 235° and 280° C.

Another preferred polymer that may be flash-spun to produce the partially fluorinated hydrocarbon polymer plexifilaments of the invention is comprised of 40% to 70% by weight of polymerized monomer units of vinylidene fluoride. Polyvinylidene fluoride polymer resins with the chemical structure —$(CH_2CF_2)$— are commercially available from Elf Atochem under the tradename KYNAR®, which is a registered trademark of Elf Atochem. KYNAR® fluoropolymer resins have a melting point of about 170° C.

Other polymers that may be flash-spun to produce the partially fluorinated hydrocarbon polymer plexifilaments of the invention include ethylene/chlorotrifluoroethylene copolymers and polyvinyl fluoride. Other monomer units that may be present in the flash-spun partially fluorinated hydrocarbon polymer plexifilaments include vinyl ethers or branched olefins, either unsubstituted or fluorinated such as, for example, perfluoro(propyl vinyl ether) and perfluoro (butyl vinyl ether).

While the temperature and pressure conditions that can be withstood by solution flash-spinning equipment are quite broad, it is generally preferred not to operate under extreme temperature and pressure conditions. The preferred temperature range for flash-spinning the partially fluorinated hydrocarbon polymers flash-spun according to the invention is about 150° to 300° C. while the preferred pressure range for flash-spinning is in the range of the autogenous pressure of the solution to 7250 psig (50 MPa), and more preferably from the autogenous pressure of the solution to 3625 psig (25 MPa). As used herein, "autogenous pressure" is the natural vapor pressure of the spin mixture at a given temperature. Therefore, if plexifilaments are to be flash-spun from partially fluorinated hydrocarbon polymers in solution, the solvent should dissolve the partially fluorinated hydrocarbon polymers at pressures and temperatures within the preferred ranges. In order to generate the two phase solution that is needed for flash-spinning plexifilamentary film-fibrils, the solution must also have a cloud point pressure that is within the desired pressure and temperature operating ranges. In addition, the solution must form the desired two phases at a pressure that is sufficiently high to generate the explosive flashing required for the formation of plexifilaments.

As discussed, partially fluorinated hydrocarbon polymers are not soluble in common solvents under normal conditions. However, we have found that these polymers become soluble in certain types of organic solvents at high temperatures and pressures. Solvents which are capable of dissolving partially fluorinated hydrocarbon polymers at elevated temperatures and pressures include: polar solvents such as halogenated or nonhalogenated alcohols (C1 to C3), ketones (C3 to C5), acetates and carbonates; certain types of hydrochlorocarbons, hydrofluorocarbons (HFC's), hydrofluoroethers (HFE's), hydrochlorofluorocarbons (HCFC's) and perfluorinated solvents, and certain types of strong hydrocarbon solvents. It should be noted that not all of the partially fluorinated hydrocarbon polymers are soluble in all of these solvents. For example, poly (ethylene tetrafluoroethylene) is soluble in HFC4310mee and also in cyclopentane at high temperatures and pressures, but polyvinylidene fluoride is not soluble in these solvents, at least up to 250° C. and 4000 psig (27.6 MPa). Suitable flash-spinning agents must be determined for each polymer from the types of solvents listed above.

Preferred solvents for flash-spinning partially fluorinated hydrocarbon polymers will depend on the specific type of polymer to be flash-spun. However, acetone/hydrocarbon solvent (C5 to C6) mixtures, methylene chloride, and n-pentafluoropropanol are generally good flash-spinning agents for these polymers. Other flash-spinning agents that can be used for flash-spinning partially fluorinated hydrocarbon polymers include HFC-4310mee, perfluoro-N-methylmorpholine (3M's PF5052), methyl (perfluorobutyl) ether (3M's HFE 7100), dichloroethylene, ethanol, propanols, methyl ethyl ketone, cyclopentane or mixtures of these solvents. In circumstances where it is desirable to raise the cloud point pressure, minor amounts of poor solvents or nonsolvents can be added to the above solvents in order to raise the cloud point pressure. In the case of mixed solvents, a proper solvent ratio has to be chosen so that cloud point pressures of the polymer solutions to be flash-spun are in the acceptable range (e.g. higher than autogenous pressure but less lower ~50 MPa). Preferred solvent systems to be used for each polymer will be further illustrated through specific examples.

The apparatus and procedure for determining the cloud point pressures of a polymer/solvent combination are those described in the above-cited U.S. Pat. No. 5,147,586 to Shin et al. The cloud point pressures at different temperatures of a number of partially fluorinated hydrocarbons polymers in selected solvents or pairs of solvents are given in FIGS. 1–6. These plots are used in determining whether flash-spinning of a particular polymer/solvent combination is feasible. Above each curve, the copolymer is completely dissolved in the solvent system. Below each curve, separation into a polymer-rich phase and a solvent-rich phase takes place. At the boundary line, the separation into phases disappears when passing from lower pressures to higher pressures, or phase separation begins when passing from higher pressures to lower pressures.

FIG. 1 is a plot of the cloud point pressure at different temperatures for a solution of 25% by weight TEFZEL® fluoropolymer (copolymer of ethylene and tetrafluoroethylene) in a solvent comprised of pentane and acetone. FIG. 1 provides this cloud point curve at three different solvent ratios: 70% pentane/30% acetone ("10"), 60% pentane/40% acetone ("11"); and 50% pentane/50% acetone ("12"). TEFZEL® is a registered trademark of DuPont.

Figure 2:
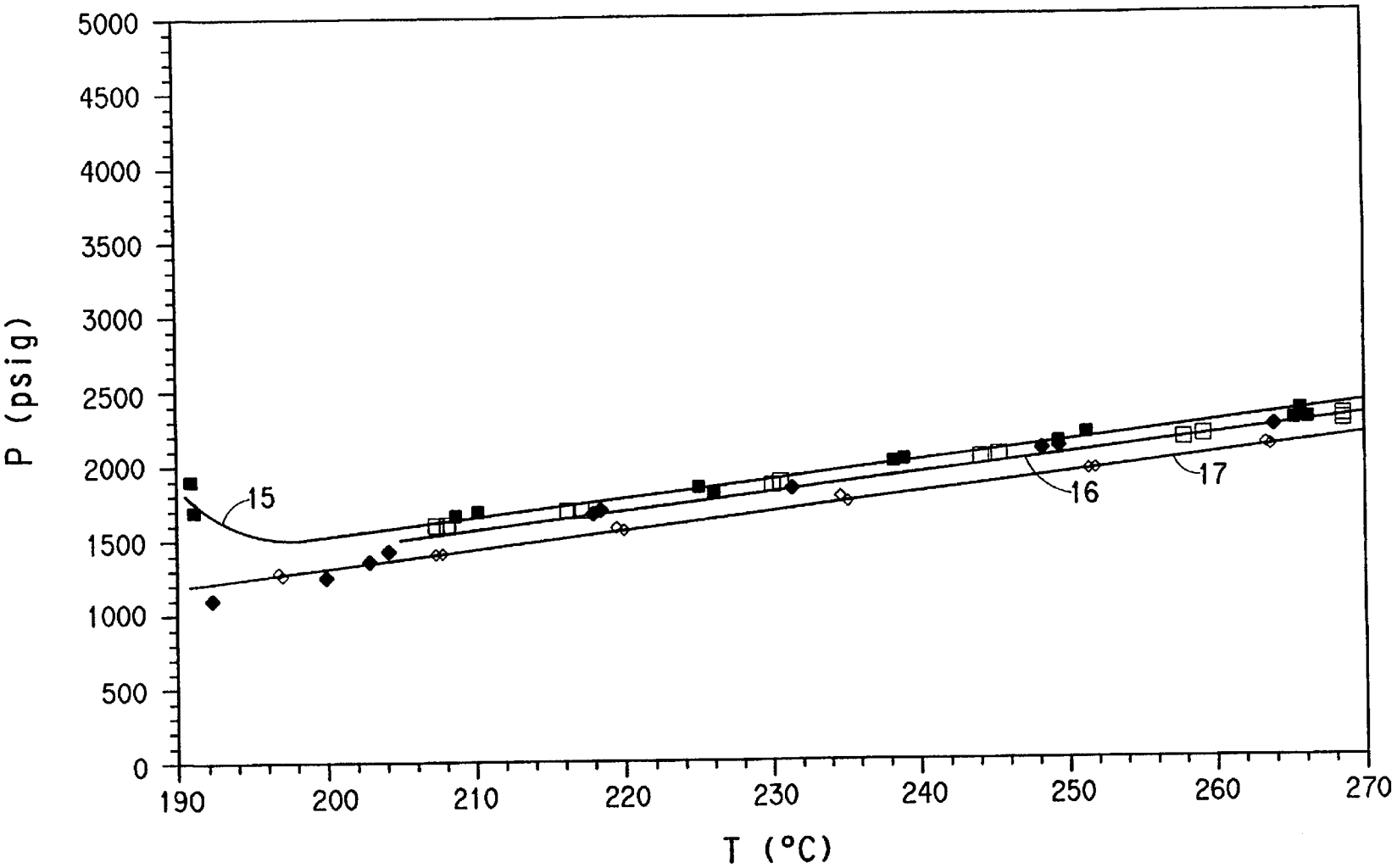
FIG. 2 is a plot of the cloud point data for a solution comprised of an ethylene/tetrafluoroethylene copolymer at various concentrations in a solvent with a ratio of 70% pentane/30% acetone.

FIG. 2 is a plot of the cloud point pressure at different temperatures for a solution of TEFZEL® fluoropolymer (copolymer of ethylene and tetrafluoroethylene) in a solvent at a ratio of 70% pentane/30% acetone. FIG. 2 shows the cloud point curve at three different concentrations of the fluoropolymer: 20% ("15"); 35% ("16"); and 40% ("17") by weight in the solvent.

Figure 3:
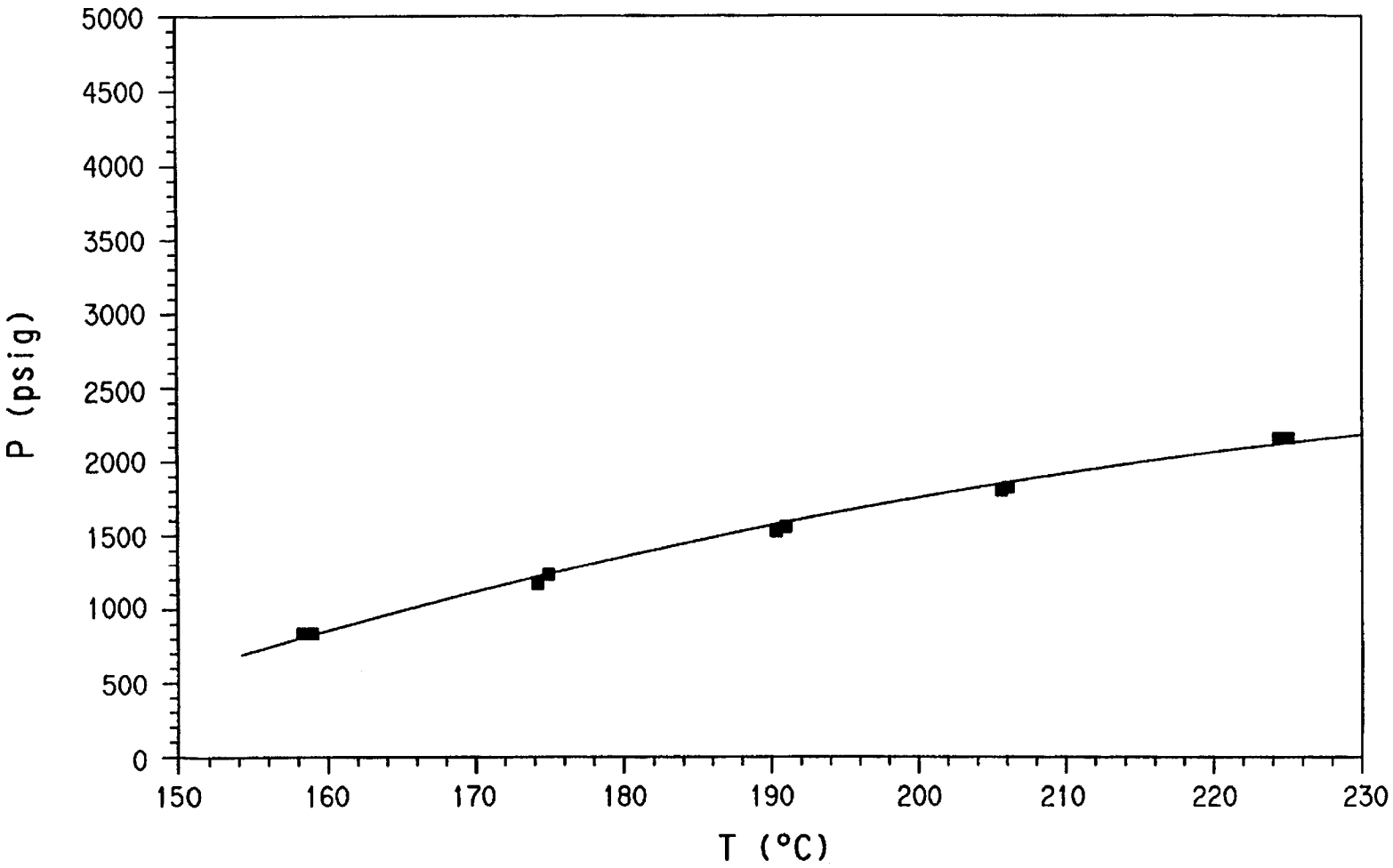
FIG. 3 is a plot of the cloud point data for a solution of 30% polyvinylidene fluoride in a solvent with a ratio of 60% acetone 40% pentane.

FIG. 3 is a plot of the cloud point pressure at different temperatures for a solution of 30% by weight KYNAR® fluoropolymer (polyvinylidene fluoride) in a solvent with a ratio of 60% acetone/40% pentane. KYNAR® is a registered trademark of Elf Atochem.

Figure 4:
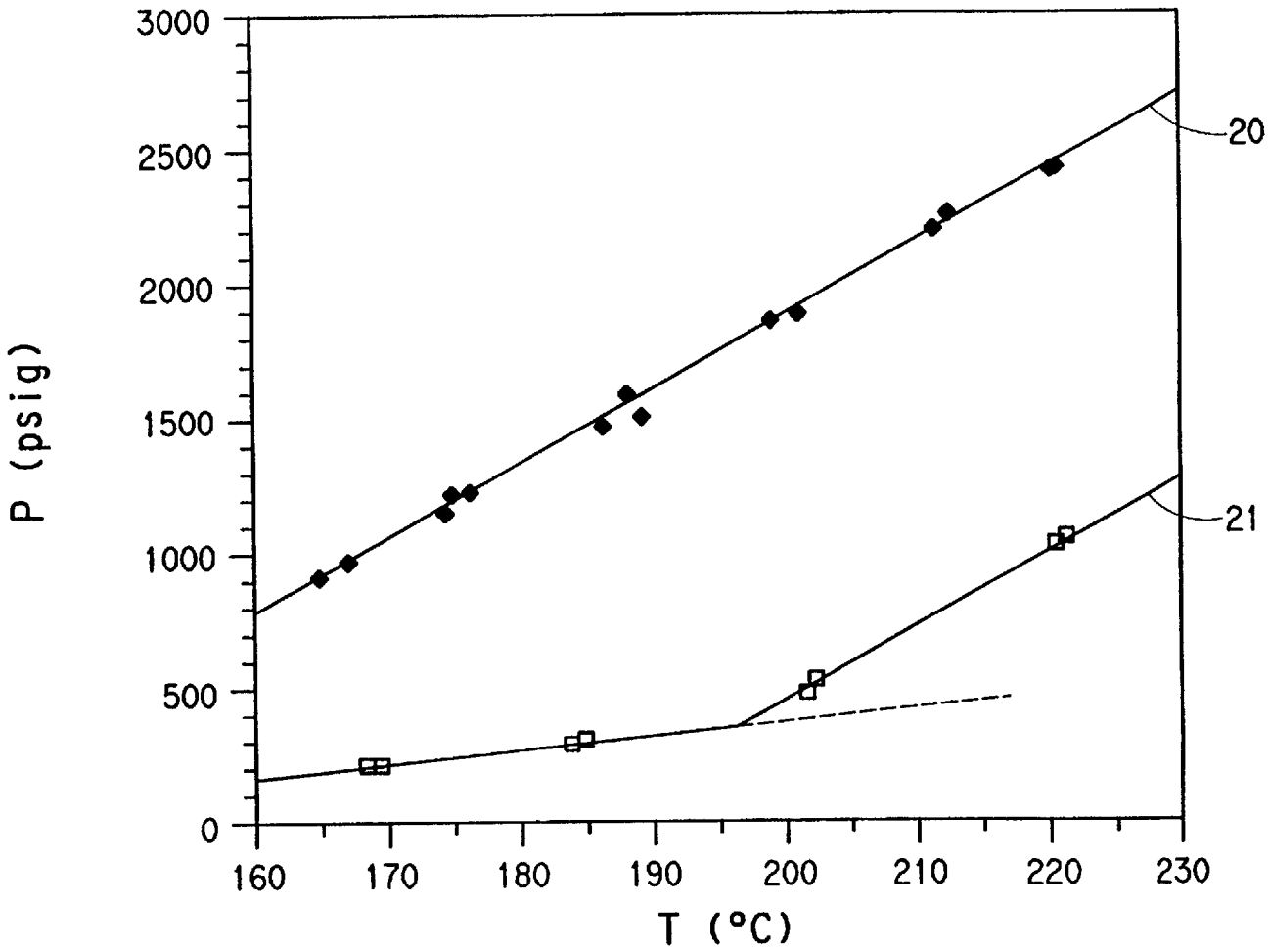
FIG. 4 is a plot of the cloud point data for a solution of 35% polyvinyl fluoride in solvents comprised of either 20% pentane and 80% acetone or 100% acetone.

FIG. 4 is a plot of the cloud point pressure at different temperatures for a solution of 35% by weight TEDLAR® fluoropolymer (polyfluoroethylene) in a solvent with a ratio of 20% pentane/80% acetone ("20"). FIG. 4 also shows the cloud point data for a solution of TEDLAR® fluoropolymer in a solvent comprised of 100% acetone ("21"). TEDLAR® is a registered trademark of DuPont.

Figure 5:
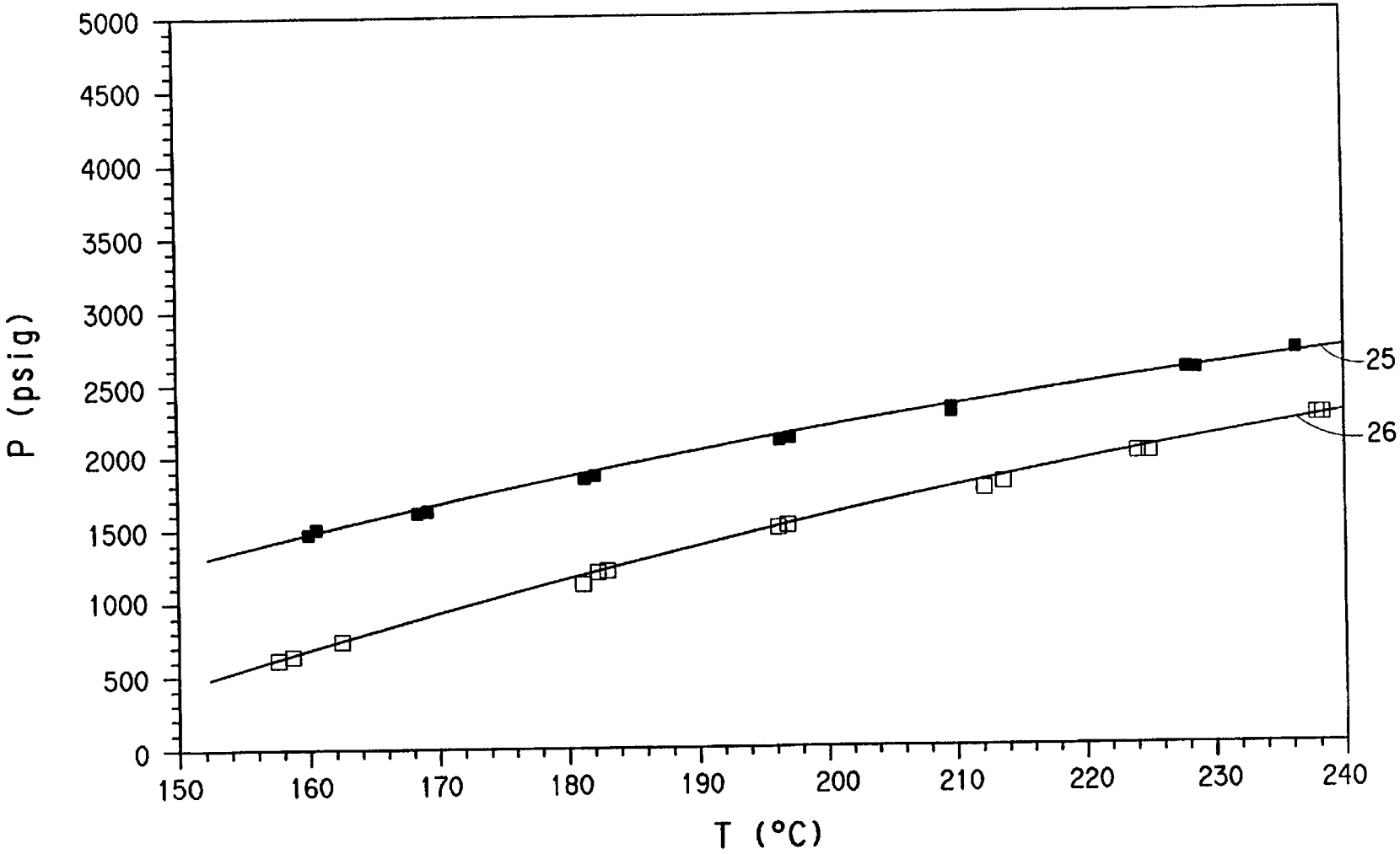
FIG. 5 is a plot of the cloud point data for a solution of a 30% copolymer of alternating monomer units of ethylene and chlorotrifluoroethylene in a solvent comprised of pentane/acetone at a number of different solvent ratios.

FIG. 5 is a plot of the cloud point pressure at different temperatures for a solution of 30% by weight HALAR® fluoropolymer (copolymer of alternating monomer units of ethylene and chlorotrifluoroethylene) in a solvent comprised of pentane and acetone. FIG. 5 provides this cloud point data at two different solvent ratios: 70% pentane/30% acetone ("25"); and 50% pentane/50% acetone ("26"). HALAR® is a registered trademark of Ausimont.

Figure 6:
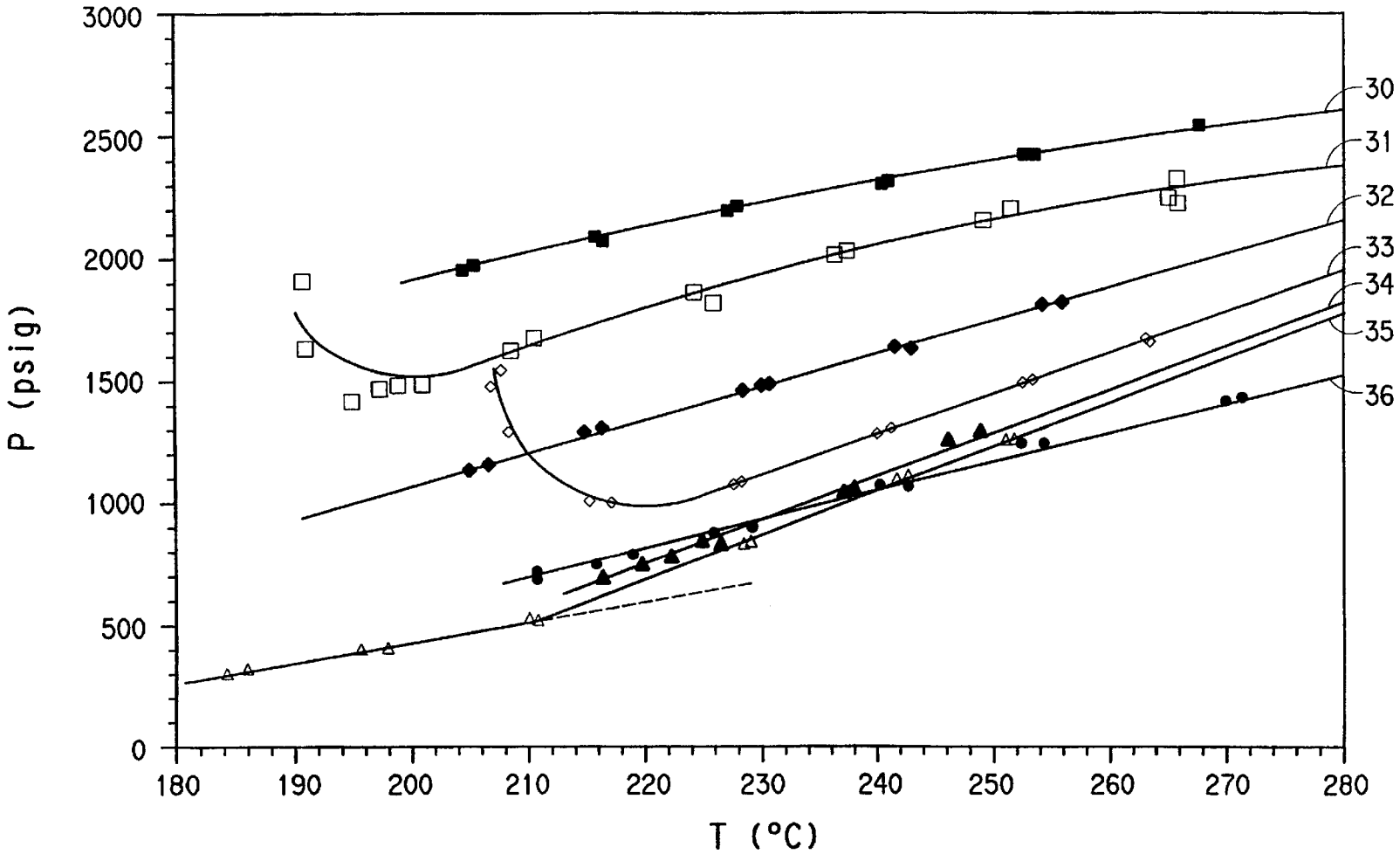
FIG. 6 is a plot of the cloud point data for an ethylene/tetrafluoroethylene copolymer in a number of different solvents.

FIG. 6 is a plot of the cloud point pressure at different temperatures for an ethylene/tetrafluoroethylene copolymer (Tefzel® 750 obtained from DuPont) in a number of different solvents. Curve 30 shows the cloud point pressures in a solution of 20% copolymer in HFC-4310mee ($CF_3CHFCHFCF_2CF_3$) solvent. Curve 31 shows the cloud point pressures in a solution of 20% copolymer in a solvent of 70% pentane and 30% acetone. Curve 32 shows the cloud point pressures in a solution of 12% copolymer in pentafluoropropanol. Curve 33 shows the cloud point pressures in a solution of 20% copolymer in 2-propanol. Curve 34 shows the cloud point pressures in a solution of 12% copolymer in methylene chloride ($CH_2Cl_2$). Curve 35 shows the cloud point pressures in a solution of 20% copolymer in acetone. Curve 36 shows the cloud point pressures in a solution of 20% cyclopentane (99%).

This invention will now be illustrated by the following non-limiting examples which are intended to illustrate the invention and not to limit the invention in any manner.

EXAMPLES

Test Methods

In the description above and in the non-limiting examples that follow, the following test methods were employed to determine various reported characteristics and properties. ASTM refers to the American Society of Testing Materials, and TAPPI refers to the Technical Association of the Pulp and Paper Industry.

The denier of the strand is determined from the weight of a 15 cm sample length of strand.

Tenacity, elongation and toughness of the flash-spun strand are determined with an Instron tensile-testing machine. The strands are conditioned and tested at 70° F. and 65% relative humidity. The strands are then twisted to 10 turns per inch and mounted in the jaws of the Instron Tester. A two-inch gauge length was used with an initial elongation rate of 4 inches per minute. The tenacity at break is recorded in grams per denier (gpd). The elongation at break is recorded as a percentage of the two-inch gauge length of the sample. Toughness is a measure of the work required to break the sample divided by the denier of the sample and is recorded in gpd. Modulus corresponds to the slope of the stress/strain curve and is expressed in units of gpd.

Fiber quality in Examples 22 and 23 was evaluated using a subjective scale of 0 to 3, with a 3 being the highest quality rating. Under the evaluation procedure, a 10 inch length of a plexifilamentary strand is removed from a fiber batt. The web is spread and mounted on a dark substrate. The fiber quality rating is an average of three subjective ratings, one for fineness of the fiber (finer fibers receive higher ratings), one for the continuity of the fiber strand (continuous plexifilamentary strands receive a higher rating), and the other for the frequency of the ties (more networked plexifilamentary strands receive a higher rating).

Fiber fineness is measured using a technique similar to that disclosed in U.S. Pat. No. 5,371,810 to A. Ganesh Vaidyanathan dated Dec. 6, 1994, and which is hereby incorporated by reference. This technique quantitatively analyzes fibril size in webs of fiber. The webs are opened up by hand and imaged using a microscopic lens. The image is then digitized and computer analyzed to determine the mean fibril width and standard deviation. However, some smaller fibrils may be so tightly bunched together and have such short fibril length, that the fibrils appear as part of a large fibril and are counted as such. Tight fibril bunching and short fibril length (distance from tie point to tie point) can effectively prevent analysis of the fineness of individual fibrils in the bunched fibrils. Thus, the term "apparent fibril size" is used to describe or characterize fibers of plexifilamentary strands.

The surface area of the plexifilamentary film-fibril strand product is another measure of the degree and fineness of fibrillation of the flash-spun product. Surface area is measured by the BET nitrogen absorption method of S. Brunauer, P. H. Emmett and E. Teller. J. Am. Chem. Soc., V. 60 p 309–319 (1938) and is reported as $m^2/g$.

Test Apparatus for Examples 1–21

The apparatus used in the examples 1–21 is the spinning apparatus described in U.S. Pat. No. 5,147,586. The apparatus consists of two high pressure cylindrical chambers, each equipped with a piston which is adapted to apply pressure to the contents of the chamber. The cylinders have an inside diameter of 1.0 inch (2.54 cm) and each has an internal capacity of 50 cubic centimeters. The cylinders are connected to each other at one end through a 3/32 inch (0.23 cm) diameter channel and a mixing chamber containing a series of fine mesh screens that act as a static mixer. Mixing is accomplished by forcing the contents of the vessel back and forth between the two cylinders through the static mixer. A spinneret assembly with a quick-acting means for opening the orifice is attached to the channel through a tee. The spinneret assembly consists of a lead hole of 0.25 inch (0.63 cm) diameter and about 2.0 inch (5.08 cm) length, and a spinneret orifice with both a length and a diameter shown in the tables below. Orifice measurements are expressed in mils [1 mil=0.0254 mm]. The pistons are driven by high pressure water supplied by a hydraulic system.

In the tests reported in Examples 1–21, the apparatus described above was charged with pellets of a partially fluorinated hydrocarbon polymer and a solvent. High pressure water was used to drive the pistons to generate a mixing pressure of between 1500 and 3000 psi (10,340–10,680 kPa). The polymer and solvent were next heated to mixing temperature and held at that temperature for about an hour during which time the pistons were used to alternately establish a differential pressure of about 50 psi (345 kPa) or higher between the two cylinders so as to repeatedly force the polymer and solvent through the mixing channel from one cylinder to the other to provide mixing and effect formation of a spin mixture. The spin mixture temperature was then raised to the final spin temperature, and held there for about 15 minutes to equilibrate the temperature, during which time mixing was continued. In order to simulate a pressure letdown chamber, the pressure of the spin mixture was reduced to a desired spinning pressure just prior to spinning. This was accomplished by opening a valve between the spin cell and a much larger tank of high pressure water ("the accumulator") held at the desired spinning pressure. The spinneret orifice is opened about one to five seconds after the opening of the valve between the spin cell and the accumulator. This period roughly corresponds to the residence time in the letdown chamber of a commercial spinning apparatus. The resultant flash-spun product is collected in a stainless steel open mesh screen basket. The pressure recorded just before the spinneret using a computer during spinning is entered as the spin pressure.

The experimental conditions and the results for Examples 1–21 are given below in the Tables 1–5. All the test data not originally obtained in the SI system of units has been converted to the SI units.

EXAMPLES 1–7

In Examples 1–7, a copolymer of alternating monomer units of ethylene and tetrafluoroethylene was flash-spun from a number of solvents. The copolymer used in Examples 1–7 was TEFZEL® fluoropolymer obtained from DuPont in the following grades:

| Name and Grade | Melt Flow Rate | Melting Point |
|---|---|---|
| Tefzel 750 | 7 g/10 min | ~250° C. |
| Tefzel HT 2129 | 7 g/10 min | ~235° C. |
| Tefzel 200 | 7 g/10 min | ~280° C. |
| Tefzel 280 | 4 g/10 min | ~280° C. |

The solvents used include acetone, methylene chloride ($CH_2Cl_2$) and Vertrel 245 (perfluoro(dimethylcyclobutane)) obtained from DuPont.

TABLE 1

| | POLYMER | | SOLVENT | | | MIXING | | | SPINNING Orifice | | | Properties @ 10 tpi | | | | | |
|---|---|---|---|---|---|---|---|---|---|---|---|---|---|---|---|---|---|
| Ex. No. | NAME | Wt % | 1 | 2 | S1/S2 Wt % | ° C. | Min | Press MPa | D × L mils | Press MPa | ° C. | Den | Mod gpd | Ten gpd | E % | BET SA | Type |
| 1 | TEFZEL (HT750) | 12 | CH2Cl2 | VERTREL 245 | 50/50 | 200 | 60 | 13.8 | 30 × 30 | 7.6 | 200 | 217 | 2.69 | 1.37 | 30.7 | nm | plex |
| 2 | TEFZEL (HT750) | 25 | PENTANE | ACETONE | 70/30 | 220 | — | 17.2 | 30 × 30 | 9.7 | 220 | 285 | 0.98 | 1.01 | 35 | nm | plex |

TABLE 1-continued

| | POLYMER | | SOLVENT | | | MIXING | | | SPINNING Orifice | | | Properties @ 10 tpi | | | | | |
|---|---|---|---|---|---|---|---|---|---|---|---|---|---|---|---|---|---|
| Ex. No. | NAME | Wt % | 1 | 2 | S1/S2 Wt % | ° C. | Min | Press MPa | D × L mils | Press MPa | ° C. | Den | Mod gpd | Ten gpd | E % | BET SA | Type |
| 3 | TEFZEL (200) | 35 | PENTANE | ACETONE | 70/30 | 250 | 60 | 20.7 | 30 × 30 | 11.7 | 250 | 448 | 0.97 | 1.21 | 29 | 22 | plex |
| 4 | TEFZEL (280) | 35 | PENTANE | ACETONE | 70/30 | 250 | 45 | 20.7 | 30 × 30 | 11.7 | 250 | 369 | 0.96 | 1.6 | 27 | nm | plex |
| 5 | TEFZEL (HT2129) | 35 | PENTANE | ACETONE | 80/20 | 230 | 45 | 20.7 | 30 × 30 | 12.4 | 230 | 418 | 1.59 | 1.3 | 28 | nm | plex |
| 6 | TEFZEL (H750) | 40 | PENTANE | ACETONE | 80/20 | 220 | 60 | 20.7 | 30 × 30 | 10.3 | 220 | 852 | 1.0 | 1.26 | 28 | 30 | plex |
| 7 | TEFZEL (HT750) | 55 | ACETONE | NONE | 100/0 | 220 | 60 | 13.8 | 4 × 4 | 13.8 | 223 | 30 | 8.38 | 1.34 | 25 | 67 | foam |

footnote: nm = not measured

EXAMPLES 8–12

In Examples 8–12, the following KYNAR® fluoropolymer resin obtained from Elf Atochem, comprised of polymerized monomer units of vinylidene fluoride, was flash-spun from a number of solvents:

| Name and Grade | Melt Flow Rate | Melting Point |
|---|---|---|
| Kynar 760 | 2–4 g/10 min | 165–170° C. |

The solvents used include acetone, ethanol, pentane, 2-propanol, methylene chloride ($CH_2Cl_2$), and HFC-4310mee ($CF_3CHFCHFCF_2CF_3$).

EXAMPLES 13–14

In Examples 13 and 14, the following HALAR® fluoropolymer resin obtained from Ausimont, and comprised of a copolymer of polymerized monomer units of ethylene and chlorotrifluoroethylene, was flash-spun from a number of solvents identified in the examples above.

| Name and Grade | Melt Index | Melting Point |
|---|---|---|
| Halar 200 | 0.7 | 240° C. |

The solvents include pentane, acetone, and methylene chloride ($CHCl_2$).

TABLE 2

| | POLYMER | | SOLVENT | | | MIXING | | | SPINNING Orifice | | | Properties @ 10 tpi | | | | | |
|---|---|---|---|---|---|---|---|---|---|---|---|---|---|---|---|---|---|
| Ex. No. | NAME | Wt % | 1 | 2 | S1/S2 Wt % | ° C. | Min | Press MPa | D × L mils | Press MPa | ° C. | Den | Mod gpd | Ten gpd | E % | BET SA | Type |
| 8 | KYNAR (760) | 12 | CH2Cl2 | HFC-43-10 mee | 75/25 | 200 | 45 | 17.2 | 30 × 30 | 10.7 | 200 | 224 | 0.93 | 1.11 | 84 | nm | plex |
| 9 | KYNAR (760) | 30 | 2-PRO-PANOL | NONE | 100/0 | 230 | 60 | 13.8 | 30 × 30 | 5.5 | 232 | 328 | 3.6 | 1.56 | 62 | 10.4 | plex |
| 10 | KYNAR (760) | 30 | ACE-TONE | PENTANE | 60/40 | 210 | 60 | 17.2 | 30 × 30 | 11 | 210 | 407 | 0.88 | 1.15 | 60 | nm | plex |
| 11 | KYNAR (760) | 30 | ETH-ANOL | NONE | 100/0 | 250 | 60 | 17.2 | 30 × 30 | 9.0 | 248 | 259 | 2.7 | 1.25 | 73 | 7.56 | plex |
| 12 | KYNAR (760) | 45 | ACE-TONE | NONE | 100/0 | 220 | 60 | 13.8 | 4 × 4 | 13.8 | 224 | 18.4 | 3.96 | 1.64 | 68 | 61.1 | foam |

TABLE 3

| | POLYMER | | SOLVENT | | | MIXING | | | SPINNING Orifice | | | Properties @ 10 tpi | | | | | |
|---|---|---|---|---|---|---|---|---|---|---|---|---|---|---|---|---|---|
| Ex. No. | NAME | Wt % | 1 | 2 | S1/S2 Wt % | ° C. | Min | Press MPa | D × L mils | Press MPa | ° C. | Den | Mod gpd | Ten gpd | E % | BET SA | Type |
| 13 | HALAR (200) | 30 | PEN-TANE | ACE-TONE | 50/50 | 220–230 | 75 | 20.7 | 30 × 30 | 12.7 | 240 | 496 | 3.79 | 1.44 | 24 | 17.6 | plex |
| 14 | HALAR (200) | 38 | CH2Cl2 | NONE | 100/0 | 160 | 30 | 10.3 | 30 × 30 | 4.7 | 159 | nm | nm | nm | nm | nm | foam |

EXAMPLE 15

In Example 15, the following TEDLAR® fluoropolymer resin obtained from DuPont, and comprised of polymerized monomer units of vinyl fluoride, was flash-spun from an acetone/pentane solvent system:

| Name and Grade | Melting Point |
|---|---|
| Tedlar PV318 (High MW grade) | 190° C. |

EXAMPLES 16–21

In Examples 16–21, polymer blends of ALATHON® polyethylene obtained from Lyondell Petrochemical Company and KYNAR® polyvinylidene fluoride obtained from Elf Atochem were flash-spun from different solvents. The Kynar described above with Examples 8–12. The polyethylene was the following high density polyethylene:

TABLE 4

| | POLYMER | | SOLVENT | | | MIXING | | | SPINNING Orifice | | | Properties @ 10 tpi | | | | | |
|---|---|---|---|---|---|---|---|---|---|---|---|---|---|---|---|---|---|
| Ex. No. | NAME | Wt % | 1 | 2 | S1/S2 Wt % | ° C. | Min | Press MPa | D × L mils | Press MPa | ° C. | Den | Mod gpd | Ten gpd | E % | BET SA | Type |
| 15 | Tedlar | 40 | ACETONE | PENTANE | 80/20 | 160 | 60 | 1500 | 30 × 30 | 1125 | 160 | nm | nm | nm | nm | nm | Pulp |

The solvents include acetone and pentane.

| Polymer Name and Grade | Melt Index | Density | Avg. Molecular Weight |
|---|---|---|---|
| PE Alathon | ~0.75 | ~0.957 | ~125,000 |

TABLE 5

| | POLYMER | | SOLVENT | | | MIXING | | | SPINNING Orifice | | | Properties @ 10 TPI | | | | | |
|---|---|---|---|---|---|---|---|---|---|---|---|---|---|---|---|---|---|
| Ex. No. | Name | Wt % | 1 | 2 | S1/S2 Wt % | ° C. | Min | Press MPa | D × L mils | Press MPa | ° C. | Den | Mod gpd | Ten gpd | E % | BET SA | Type |
| 16 | PE Alathon Kynar (760) | 30 | Cyclo-pentane 99% | Acetone | 60/40 | 250 | 45 | 13.8 | 30 × 30 | 6.7 | 200 | 345 | 4.7 | 2.9 | 74 | nm | plex |
| 17 | PE Alathon Kynar (760) | 12 | CH2Cl2 | HFC-43-10 mee | 80/20 | 200 | 60 | 17.2 | 30 × 30 | 11.0 | 200 | 282 | 6.1 | 2.3 | 76 | nm | plex |
| 18 | PE Alathon Kynar (760) | 12 | CH2Cl2 | HFC-43-10 mee | 80/20 | 200 | 60 | 17.2 | 30 × 30 | 10.3 | 200 | 283 | 5.9 | 2.3 | 99 | 8.2 | plex |
| 19 | PE Alathon Kynar (760) | 12 | CH2Cl2 | HFC-43-10 mee | 80/20 | 200 | 60 | 17.2 | 30 × 30 | 10.2 | 199 | 299 | 3.8 | 1.6 | 102 | nm | plex |
| 20 | PE Alathon Kynar (760) | 12 | CH2Cl2 | HFC-43-10 mee | 80/20 | 200 | 60 | 17.2 | 30 × 30 | 11.0 | 202 | 279 | 8.6 | 3.6 | 88 | 12 | plex |
| 21 | PE Alathon Kynar (760) | 12 | CH2Cl2 | HFC-43-10 mee | 80/20 | 200 | 60 | 17.2 | 30 × 30 | 11.0 | 202 | 252 | 9.2 | 3.8 | 86 | nm | plex |

The solvents include cyclopentane, acetone and HFC-4310mee ($CF_3CHFCHFCF_2CF_3$).

Test Apparatus for Examples 22 and 23

In Examples 22 and 23, plexifilaments were spun from a spin mixture that comprised a partially fluorinated hydrocarbon polymer or copolymer dispersed in a spin agent. The spin mixture, was generated in a continuous rotary mixer, as described in U.S. patent application Ser. No. 60/005,875. The mixer operated at temperatures up to 300° C. and at pressures up to 41,000 kPa. The mixer had a polymer inlet through which a polymer melt blend was continuously introduced into the mixer. The mixer also had a $CO_2$ inlet through which supercritical $CO_2$ was continuously introduced into the polymer stream entering the mixer before the polymer entered the mixing chamber of the mixer. The mixer had a mixing chamber where polymer and $CO_2$ were thoroughly sheared and mixed by a combination of rotating and fixed cutting blades. The mixer further included an injection port through which water was introduced into the mixing chamber at a point downstream of where the polymer and $CO_2$ were initially mixed in the mixing chamber. At least one additional set of rotating and fixed cutting blades in the mixing chamber further mixed the polymer, $CO_2$ and water before the mixture was continuously discharged from the mixer's mixing chamber. The volume of the mixer's mixing chamber between the point where the polymer first contacts $CO_2$ plasticizing agent and the mixer outlet was 495 $cm^3$.

The mixer was operated at a rotational rate of approximately 1200 rpm with power of between 7 and 10 kW. Polymer was injected into the mixer by a polymer screw extruder and gear pump. Supercritical $CO_2$ plasticizing agent from a pressurized storage tank and distilled water from a closed storage tank were both injected into the mixer by double acting piston pumps. A dispersion of polymer, supercritical $CO_2$ and water was generated in the mixer's mixing chamber. The spin mixture was discharged from the mixer and passed through a heated transfer line to a 31 mil diameter round spin orifice from which the mixture was flash-spun into a zone maintained at atmospheric pressure and room temperature. The residence time of the polymer in the mixer's mixing chamber was generally between 7 and 20 seconds. Unless stated otherwise, the spinning temperature was approximately 240° C. and the spinning pressure was approximately 28,900 kPa. The spin products were collected on a moving belt from which samples were removed for examination and testing.

The polymers that were flash-spun in Examples 22 and 23 were blends of TEFZEL® 2129 fluoropolymer (described above) and 4GT polyester. One 4GT polyester used in the following examples was CRASTIN® 6131 obtained from DuPont of Wilmington, Del. CRASTIN® is a registered trademark of DuPont. CRASTIN® 6131 was formerly sold under the name RYNITE® 6131. CRASTIN® 6131 is a non-reinforced low molecular weight 4GT polyester. CRASTIN® 6131 has a melt flow rate of 42 g/10 min by standard techniques at a temperature of 250° C. with a 2.16 kg weight, and has a melting point of 225° C. (hereinafter "4GT-6131"). A second 4GT polyester used in the following examples was CRASTIN® 6130 obtained from DuPont of Wilmington, Del. CRASTIN® 6130 is a non-reinforced 4GT polyester with a higher molecular weight than CRASTIN® 6131. CRASTIN® 6131 has a melt flow rate of 12.5 g/10 min by standard techniques at a temperature of 250° C. with a 2.16 kg weight, and has a melting point of 225° C. ("4GT-6130").

EXAMPLE 22

A melted blend of 35% 4GT-6131, 35% 4GT-6130, and 30% Tefzel 2129 was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 31 mil (0.787 mm) diameter spinning orifice for approximately 15 minutes. A plexifilamentary fiber strand was obtained that had a tenacity of 0.58 gpd, an elongation of 31.8%, a toughness of 0.11 gpd, a surface area of 9.9 $g/m^2$, and a fiber quality rating of 1.5.

EXAMPLE 23

A melted blend of 40% 4GT-6131, 40% 4GT-6130, and 20% Tefzel 2129 was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 31 mil (0.787 mm) diameter spinning orifice for approximately 15 minutes. A plexifilamentary fiber strand was obtained that had a tenacity of 0.52 gpd, an elongation of 30.1%, a toughness of 0.09 gpd, a surface area of 14.5 $g/m^2$, and a fiber quality rating of 1.5.

It will be apparent to those skilled in the art that modifications and variations can be made in the flash-spinning apparatus and process of this invention. The invention in its broader aspects is, therefore, not limited to the specific details or the illustrative examples described above. Thus, it is intended that all matter contained in the foregoing description, drawings and examples shall be interpreted as illustrative and not in a limiting sense.

What is claimed is:

1. A process for the production of flash-spun material comprised of at least 20% partially fluorinated hydrocarbon polymers wherein between 10% and 70% of the total number of hydrogen atoms in each of said partially fluorinated hydrocarbon polymers are replaced by fluorine atoms, which comprises the steps of:

forming a spin solution of said partially fluorinated hydrocarbon polymers in a solvent, said spin solution having a cloud point pressure of less than 50 MPa at temperatures in the range of 150° C. to 280° C., said solvent having an atmospheric boiling point between 0° C. and 150° C., and being selected from the group consisting of alcohols, ketones, acetates, carbonates, chlorinated hydrocarbons, hydrofluorocarbons, hydrochlorofluorocarbons, hydrofluoroethers, perfluoroethers, and cyclic hydrocarbons having five to twelve carbon atoms, said partially fluorinated hydrocarbon polymer being selected from the group consisting of polymers comprised of 40% to 70% by weight of polymerized monomer units of tetrafluoroethylene and 10% to 60% by weight of polymerized monomer units of ethylene, polymers comprised of 40% to 70% by weight of polymerized monomer units of chlorotrifluoroethylene and 10% to 60% by weight of polymerized monomer units of ethylene, polymers comprised of at least 80% by weight of a homopolymer of vinylidene fluoride, polymers comprised of at least 80% by weight of a homopolymer of vinyl fluoride; and spinning said spin solution at a pressure that is greater than the autogenous pressure of the spin solution into a region of substantially lower pressure and at a temperature at least 50° C. higher than the atmospheric boiling point of the solvent.

2. The process of claim 1 wherein said spin solution is spun at a pressure below the cloud point pressure of the spin solution to form plexifilamentary film-fibril strands.

3. The process of claim 1 wherein said spin solution is spun at a pressure above the cloud point pressure of the spin solution to form a foam.

4. A flash-spun material comprised of at least 20% partially fluorinated hydrocarbon polymers wherein between 10% and 70% of the total number of hydrogen atoms in each of said partially fluorinated hydrocarbon polymers are replaced by fluorine atoms, between 40% and 70% by weight of said partially fluorinated hydrocarbon polymers are comprised of polymerized monomer units of tetrafluoroethylene, and between 10% to 60% by weight of said partially fluorinated hydrocarbon polymers are comprised of polymerized monomer units of ethylene.

5. A flash-spun material comprised of at least 20% partially fluorinated hydrocarbon polymers wherein between 10% and 70% of the total number of hydrogen atoms in each of said partially fluorinated hydrocarbon polymers are replaced by fluorine atoms, between 40% and 70% by weight of said partially fluorinated hydrocarbon polymers are comprised of polymerized monomer units of chlorotrifluoroethylene, and between 10% to 60% by weight of said partially fluorinated hydrocarbon polymers are comprised of polymerized monomer units of ethylene.

6. A flash-spun material comprised of at least 20% partially fluorinated hydrocarbon polymers wherein between 10% and 70% of the total number of hydrogen atoms in each of said partially fluorinated hydrocarbon polymers are replaced by fluorine atoms, and at least 80% by weight of said partially fluorinated hydrocarbon polymers are comprised of a homopolymer of vinylidene fluoride.

7. A flash-spun material comprised of at least 20% partially fluorinated hydrocarbon polymers wherein between 10% and 70% of the total number of hydrogen atoms in each of said partially fluorinated hydrocarbon polymers are replaced by fluorine atoms, and at least 80% by weight of said partially fluorinated hydrocarbon polymers are comprised of a homopolymer of vinyl fluoride.

8. The flash-spun material of claim 4, 5, 6 or 7 wherein said flash-spun material is a plexifilamentary strand having a surface area, measured by the BET nitrogen adsorption method, greater than 2 $m^2/g$ comprising a three dimensional integral plexus of semicrystalline, polymeric, fibrous elements, said elements being coextensively aligned with the network axis and having the structural configuration of oriented film-fibrils, said film-fibrils having a mean film thickness of less than 4 microns and a median width of less than 25 microns.

9. A plexifilamentary pulp material comprised of the plexifilamentary strand of claim 8 wherein each of said film-fibrils has an average length of less than 3 mm.

10. The flash-spun material of claim 4, 5, 6 or 7 wherein said flash-spun material is a microcellular foam comprising substantially polyhedral cells of polymeric material having thin film-like cell walls with a mean thickness of less than 4 microns between adjoining cells.

* * * * *